US012740650B2

(12) United States Patent
Liao et al.

(10) Patent No.: US 12,740,650 B2
(45) Date of Patent: Sep. 22, 2026

(54) APPARATUS AND METHOD FOR SUPPORTING AN OBJECT

(71) Applicant: Rachel Liao, Bridgewater, MA (US)

(72) Inventors: Rachel Liao, Bridgewater, MA (US); Dick Liao, Bridgewater, MA (US)

( * ) Notice: Subject to any disclaimer, the term of this patent is extended or adjusted under 35 U.S.C. 154(b) by 8 days.

(21) Appl. No.: 18/675,618

(22) Filed: May 28, 2024

(65) Prior Publication Data

US 2024/0389762 A1 Nov. 28, 2024

Related U.S. Application Data

(60) Provisional application No. 63/469,229, filed on May 26, 2023.

(51) Int. Cl.
*A47C 27/06* (2006.01)

(52) U.S. Cl.
CPC ..... *A47C 27/065* (2013.01)

(58) Field of Classification Search
CPC ... A47C 27/065; A47C 27/062; A47C 27/063; A47C 27/144; A47C 27/20; A47C 27/148; A47C 27/15; A47C 27/146; A47C 21/046; A47C 27/085; A47C 23/04; F16F 3/0873; F16F 1/373; A61G 7/05738; A61G 7/05715; A61G 2203/74; A61G 5/1045; A61G 5/1043
USPC ..... 5/655.5, 654, 652, 909, 644, 652.1, 720, 5/716, 706, 690, 948, 739, 740, 420, 630, 5/653, 655.3, 955.8, 691, 718, 719, 901, 5/953; 267/142, 117, 145
See application file for complete search history.

(56) References Cited

U.S. PATENT DOCUMENTS 2,434,641 A * 1/1948 Burns ..... A61G 7/05769 267/117
3,251,076 A * 5/1966 Burke ..... F16F 9/0472 297/DIG. 8
3,633,228 A * 1/1972 Zysman ..... A47C 7/20 267/143

(Continued)

FOREIGN PATENT DOCUMENTS

DE 19521910 9/1996
EP 0793932 9/1997

(Continued)

OTHER PUBLICATIONS

Double Seat Cushion, Purple, https://purple.com/seat-cushions/office-chair, Apr. 2020.

*Primary Examiner* — Madison Matthews
(74) *Attorney, Agent, or Firm* — Pandiscio & Pandiscio

(57) ABSTRACT

Apparatus for cushioning and/or supporting an object, the apparatus comprising: a top surface; a bottom surface; and a plurality of support elements extending between the top surface and the bottom surface; wherein each of the plurality of support elements comprises: a first portion and a second portion; and a zone of demarcation disposed between the first portion and the second portion; wherein the first portion comprises a frustoconical body which tapers away from the zone of demarcation, wherein the second portion comprises a cylindrical body, and further wherein the plurality of support elements are arranged in an alternating pattern such that the first portion of one of the plurality of support elements is connected to the second portion of an adjacent one of the plurality of support elements.

15 Claims, 6 Drawing Sheets

(56) References Cited

U.S. PATENT DOCUMENTS

| | | | | |
|---|---|---|---|---|
| 5,749,111 | A | 5/1998 | Pearce | |
| 6,498,198 | B2 | 12/2002 | Pearce | |
| 7,730,566 | B2 | 6/2010 | Flick et al. | |
| 7,823,233 | B2 | 11/2010 | Flick et al. | |
| 7,827,636 | B2 | 11/2010 | Flick et al. | |
| 7,964,664 | B2 | 6/2011 | Pearce | |
| 8,434,748 | B1 | 5/2013 | Pearce et al. | |
| 8,549,684 | B2 | 10/2013 | Jusiak | |
| 8,607,387 | B2 | 12/2013 | Flick et al. | |
| 8,628,067 | B2 | 1/2014 | Pearce et al. | |
| 8,932,692 | B2 | 1/2015 | Pearce | |
| 2005/0223667 | A1 | 10/2005 | McCann et al. | |
| 2007/0173379 | A1 | 7/2007 | Harinishi et al. | |
| 2012/0060295 | A1* | 3/2012 | Flick | A61G 7/05738 5/655.5 |
| 2013/0167302 | A1 | 7/2013 | Pearce | |
| 2014/0325763 | A1 | 11/2014 | Mason | |
| 2016/0316927 | A1* | 11/2016 | Thomas | A47C 27/20 |
| 2019/0320811 | A1* | 10/2019 | Malkiewicz | B29C 44/60 |
| 2022/0167753 | A1 | 6/2022 | Rasmussen | |

FOREIGN PATENT DOCUMENTS

| | | | | |
|---|---|---|---|---|
| EP | 0793932 | A1 * | 9/1997 | A47G 9/10 |
| JP | 56-131849 | | 10/1981 | |
| WO | WO 2005/050053 | | 6/2005 | |
| WO | WO 2010/035237 | | 4/2010 | |

* cited by examiner

APPARATUS AND METHOD FOR SUPPORTING AN OBJECT

REFERENCE TO PENDING PRIOR PATENT APPLICATION

This patent application claims benefit of prior U.S. Provisional Patent Application Ser. No. 63/469,229, filed May 26, 2023 by Rachel Liao for NOVEL CUSHION.

The above-identified patent application is hereby incorporated herein by reference.

FIELD OF THE INVENTION

This invention relates to cushions in general, and more particularly to novel deformable cushions for supporting a mass (e.g., a person).

BACKGROUND OF THE INVENTION

Cushions are used in a wide variety of applications in order to provide a comfortable and/or supportive structure between a first object (e.g., an object having mass, such as a person) and a second object (e.g., a hard surface). Generally speaking, where the first object disposed on top of a cushion is a person, cushions act to increase comfort for the person disposed on the cushion by eliminating peak pressure areas and by evenly distributing the force from the mass of the person sitting on the cushion (i.e., the force resulting from the weight of the person under Earth's gravity) over a broad surface area.

In order to provide a comfortable and/or supportive structure between a first object and a second object, cushions must be both (i) deformable so as to deform under the weight of an object disposed on the cushion, and (ii) resilient so as to revert to their original shape/configuration once the weight of the object is removed from the cushion. To achieve this, prior art cushions often comprise a non-solid interior defined by a series of regularly shaped openings between regularly-spaced walls. By way of example but not limitation, FIG. 1 shows an exemplary prior art seat cushion 5 comprising a generally rectangular body 10 and an interior volume divided into a plurality of rectangular voids 15 separated by regularly-spaced deformable columns 20 and column walls 25. Body 10 is typically covered with a fabric cover (not shown). As a result of this construction, when, for example, a person sits on top of seat cushion 5, deformable columns 20 and column walls 25 deform somewhat under the force of the mass of the person (i.e., the weight of the person) while simultaneously providing support to counteract the force of the mass of the person (i.e., to carry the weight of the person), thereby acting to increase comfort for the person using the cushion by eliminating peak pressure areas and by evenly distributing the force from the mass of the person exerted on the cushion (i.e., from the person sitting on the cushion) over the combined area of the cushion.

However, it has been found that prior art cushions deform either too much (leading to inefficient distribution of force and/or lack of resiliency) or not enough (leading to a cushion which fails to distribute force or deforms in such a way that peak pressure areas exist).

Thus there is a need for a new and improved cushion which maintains substantial resiliency while still deforming under the mass of an object disposed on the cushion (i.e., the weight of the object) so as to eliminate peak pressure areas and evenly distribute the force resulting from the mass of the object on the cushion over a substantial area.

SUMMARY OF THE INVENTION

The present invention comprises the provision and use of a new and improved cushion which maintains substantial resiliency while still deforming under the mass of an object disposed on the cushion (i.e., the weight of the object) so as to eliminate peak pressure areas and evenly distribute the force resulting from the weight of the object on the cushion over a substantial area.

In a preferred form of the invention, there is provided apparatus for cushioning and/or supporting an object, the apparatus comprising:

- a top surface;
- a bottom surface; and
- a plurality of support elements extending between the top surface and the bottom surface;
- wherein each of the plurality of support elements comprises:
  - a first portion and a second portion; and
  - a zone of demarcation disposed between the first portion and the second portion;
  - wherein the first portion comprises a frustoconical body which tapers away from the zone of demarcation, wherein the second portion comprises a cylindrical body, and further wherein the plurality of support elements are arranged in an alternating pattern such that the first portion of one of the plurality of support elements is connected to the second portion of an adjacent one of the plurality of support elements.

In another preferred form of the invention, there is provided a method for cushioning and/or supporting an object, the method comprising:

- providing apparatus comprising:
  - a top surface;
  - a bottom surface; and
  - a plurality of support elements extending between the top surface and the bottom surface;
  - wherein each of the plurality of support elements comprises:
    - a first portion and a second portion; and
    - a zone of demarcation disposed between the first portion and the second portion;
    - wherein the first portion comprises a frustoconical body which tapers away from the zone of demarcation, wherein the second portion comprises a cylindrical body, and further wherein the plurality of support elements are arranged in an alternating pattern such that the first portion of one of the plurality of support elements is connected to the second portion of an adjacent one of the plurality of support elements; and
- disposing an object on the top surface of the apparatus such that the plurality of support elements deform under the weight of the object, whereby to support the object.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

The present invention comprises the provision and use of a new and improved cushion which maintains substantial resiliency while still deforming under the mass of an object disposed on the cushion (i.e., the weight of the object) so as to eliminate peak pressure areas and evenly distribute the force resulting from the weight of the object on the cushion over a substantial area.

Figure 1:
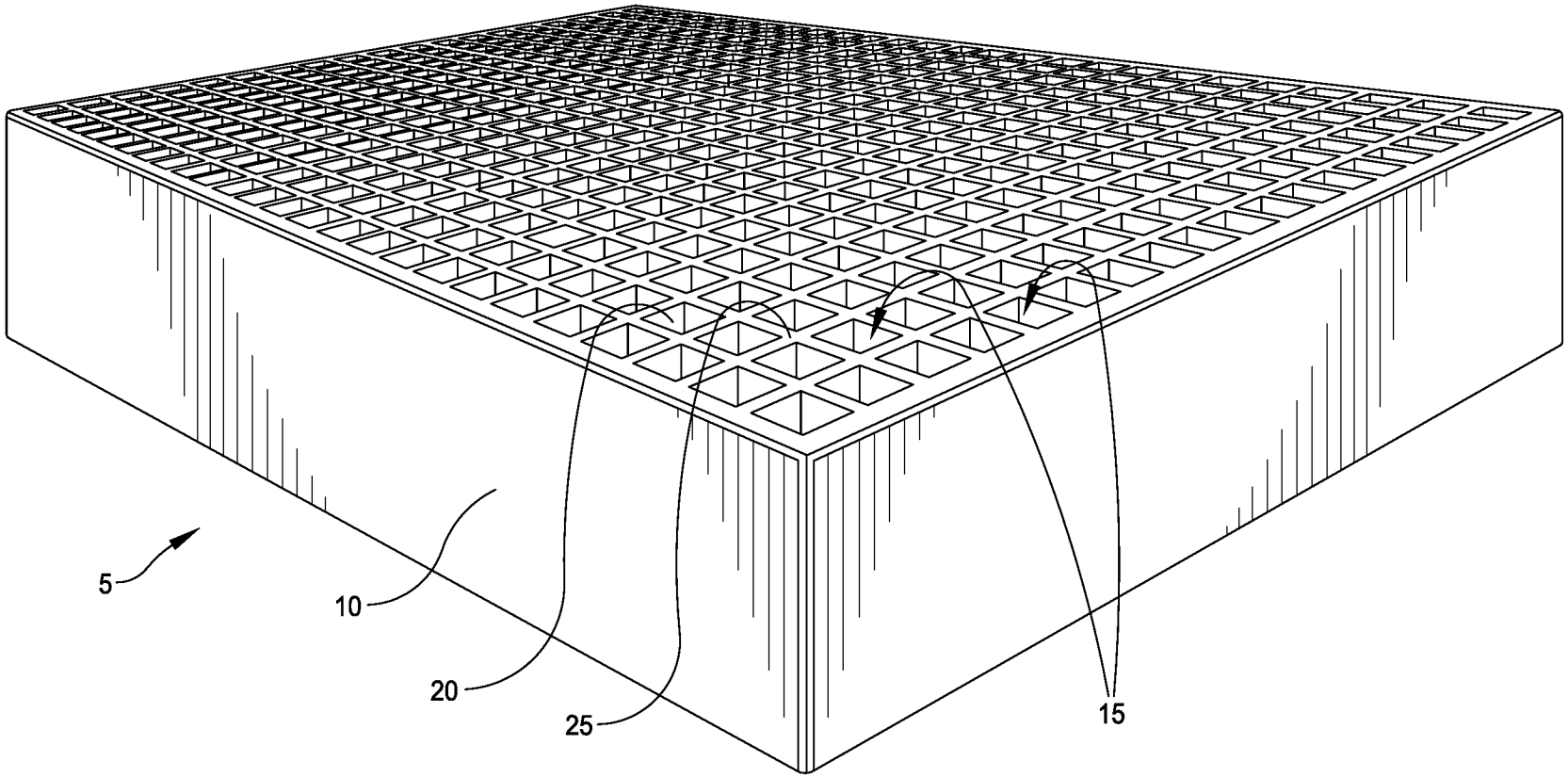
FIG. 1 (PRIOR ART)
FIG. 1 is a schematic view showing an exemplary prior art cushion.
Figure 2:
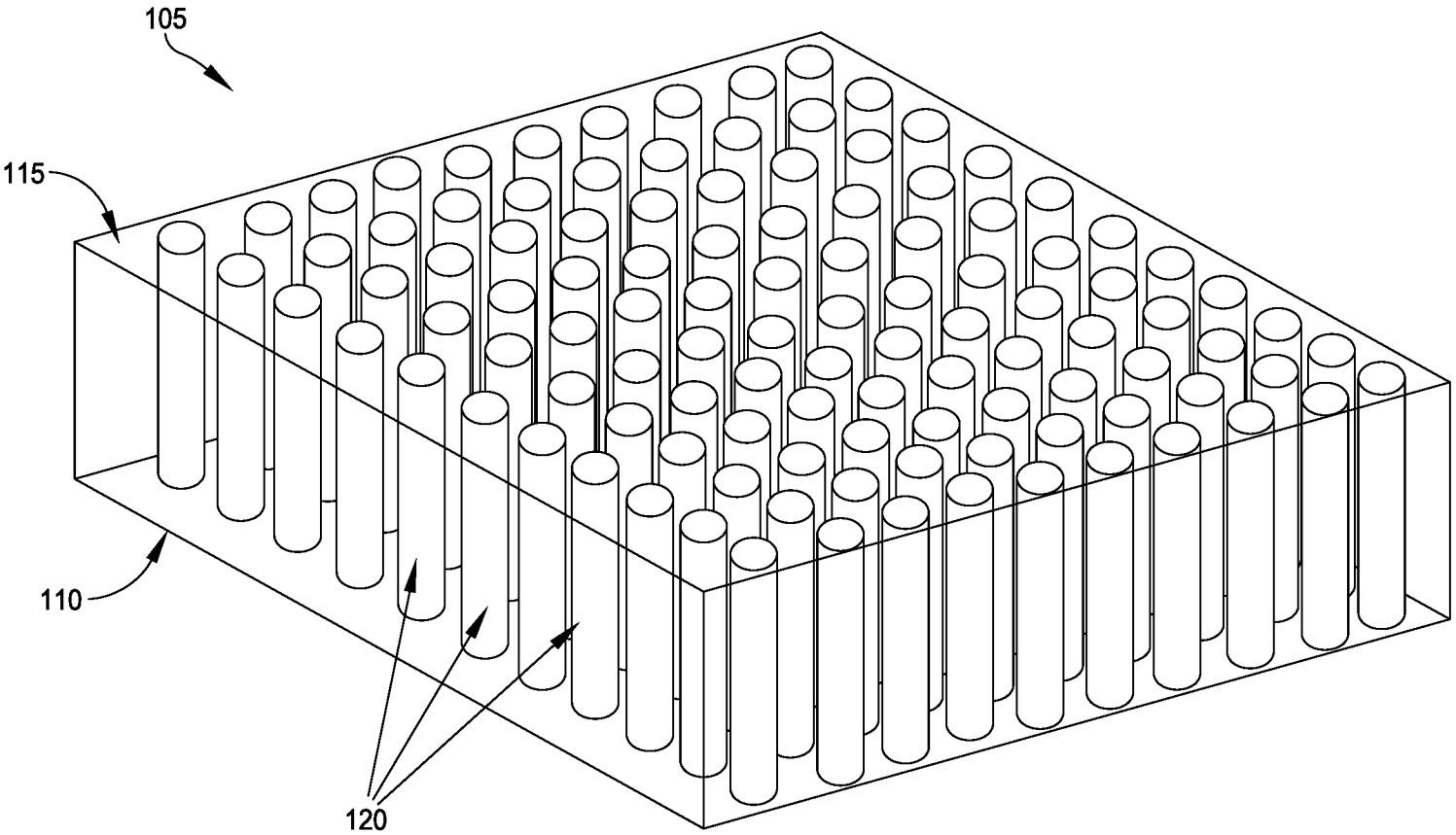
FIG. 2 is a schematic view showing a novel cushion comprising a plurality of novel support elements formed in accordance with the present invention.

More particularly, and looking now at FIG. 2, there is shown a novel cushion 105 formed in accordance with the present invention. Cushion 105 generally comprises a bottom surface 110, a top surface 115, and a plurality of support elements 120 extending between bottom surface 110 and top surface 115. It should be appreciated that support elements 120 are only depicted schematically in FIG. 2; further details concerning the novel geometry and/or interconnectedness of support elements 120 are discussed in further detail hereinbelow. It should also be appreciated that top surface 115 and bottom surface 110 are only depicted schematically in FIG. 2; top surface 115 and/or bottom surface 110 may comprise a suitable fabric covering, and/or bottom surface 110 may comprise a substantially rigid structure (e.g., wood, cardboard, plastic, etc.) as will be apparent to one of skill in the art in view of the present disclosure.

Figure 3:
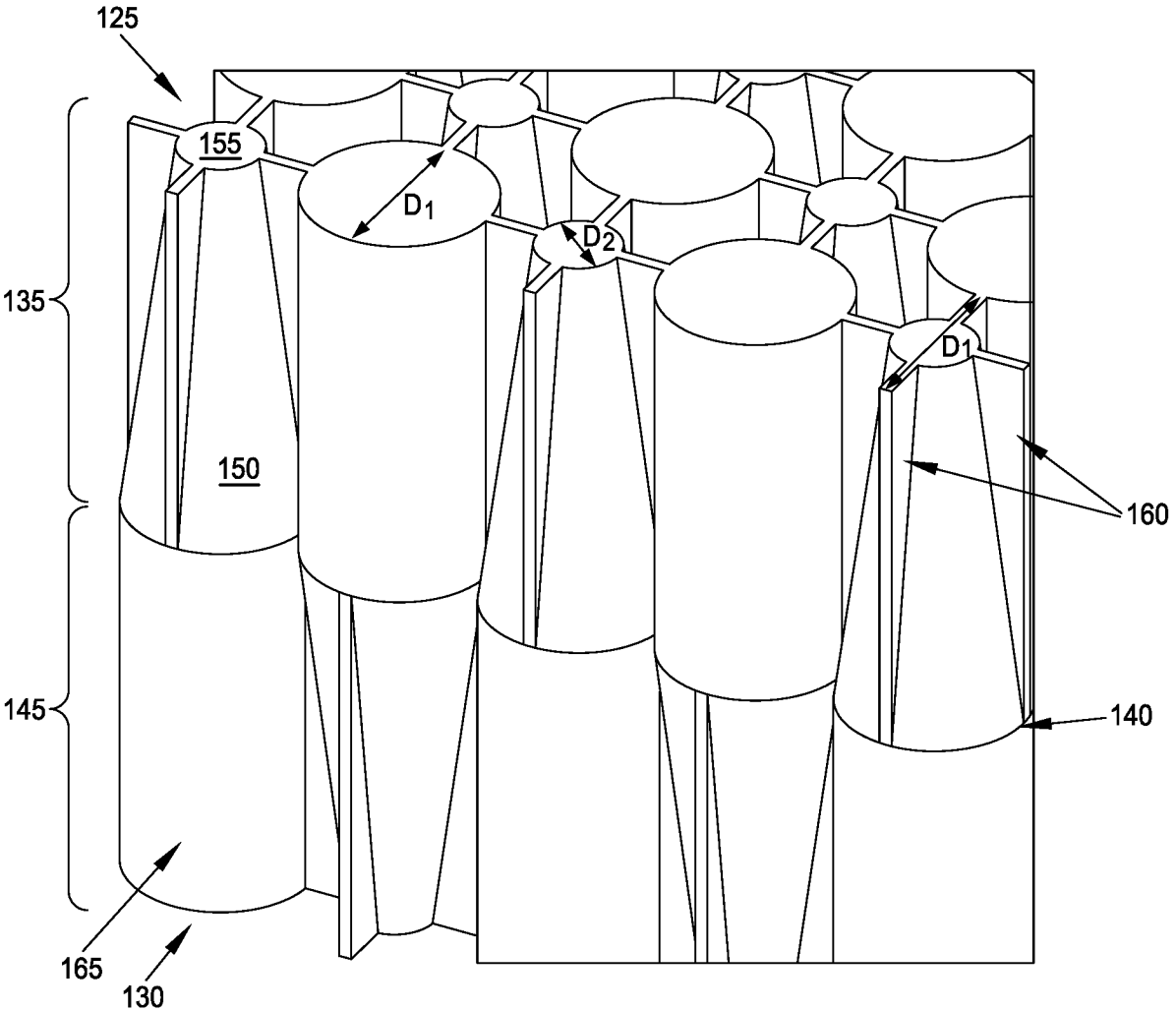
FIGS. 3-6 are schematic views showing further aspects of the novel support elements of the present invention.
Figure 4:
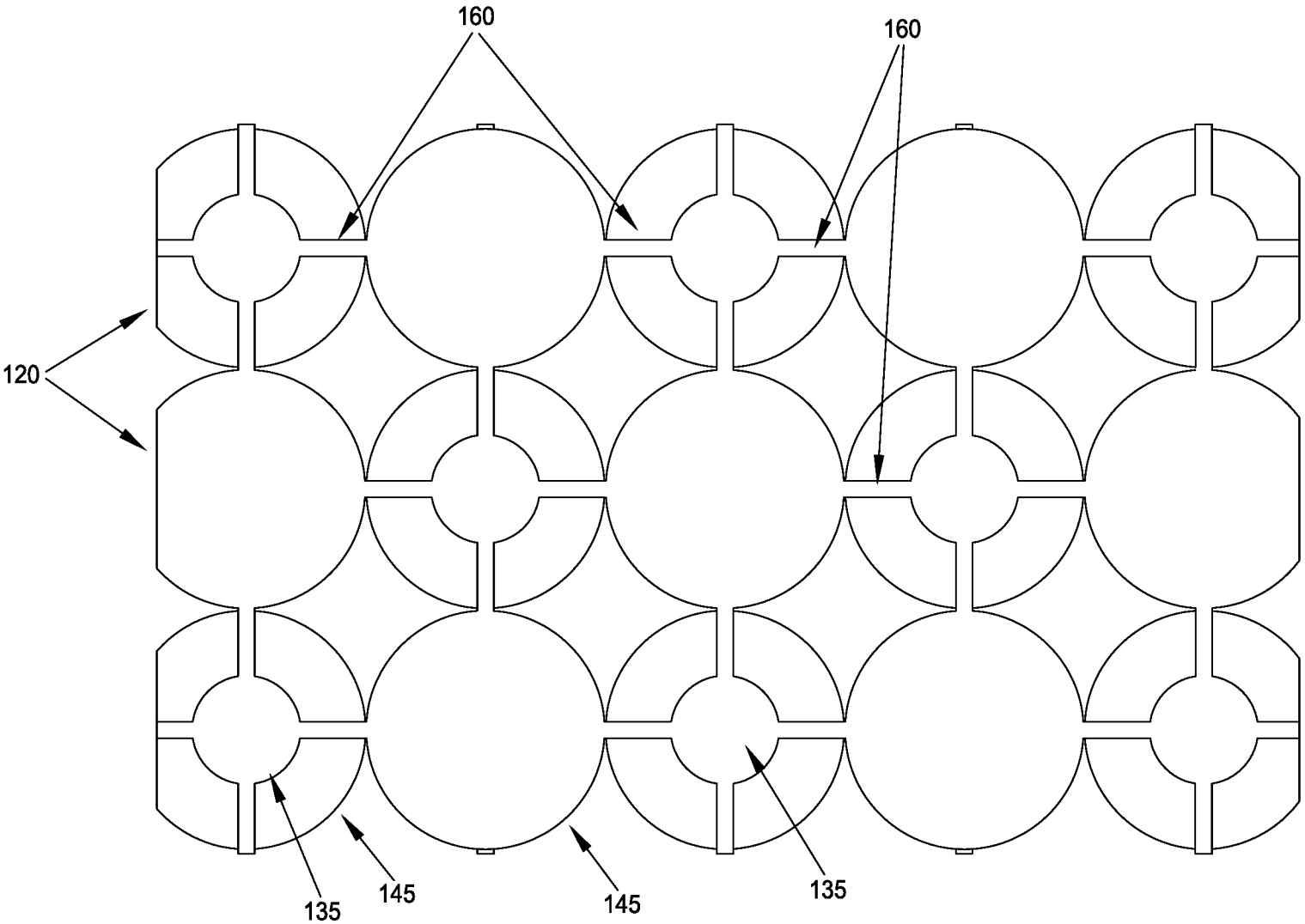
Figure 5:
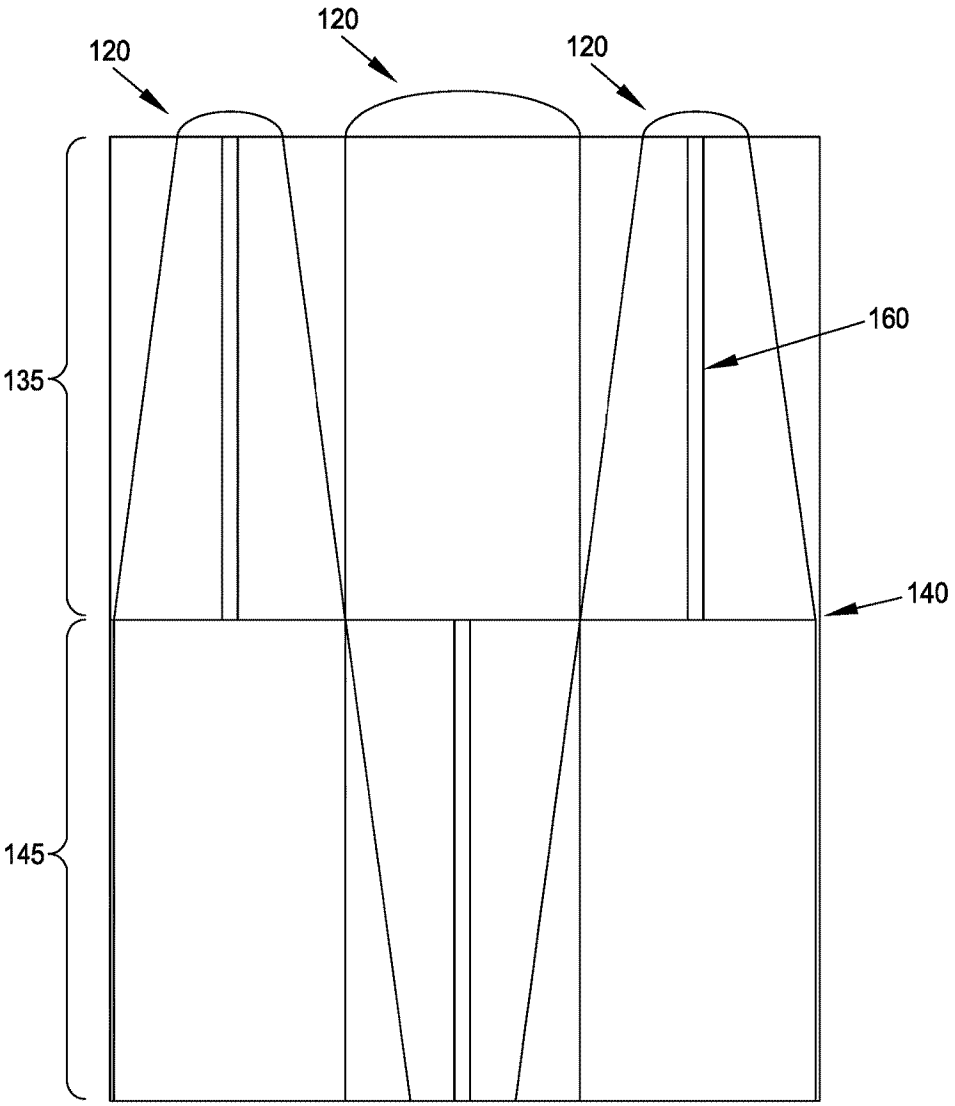
Figure 6:
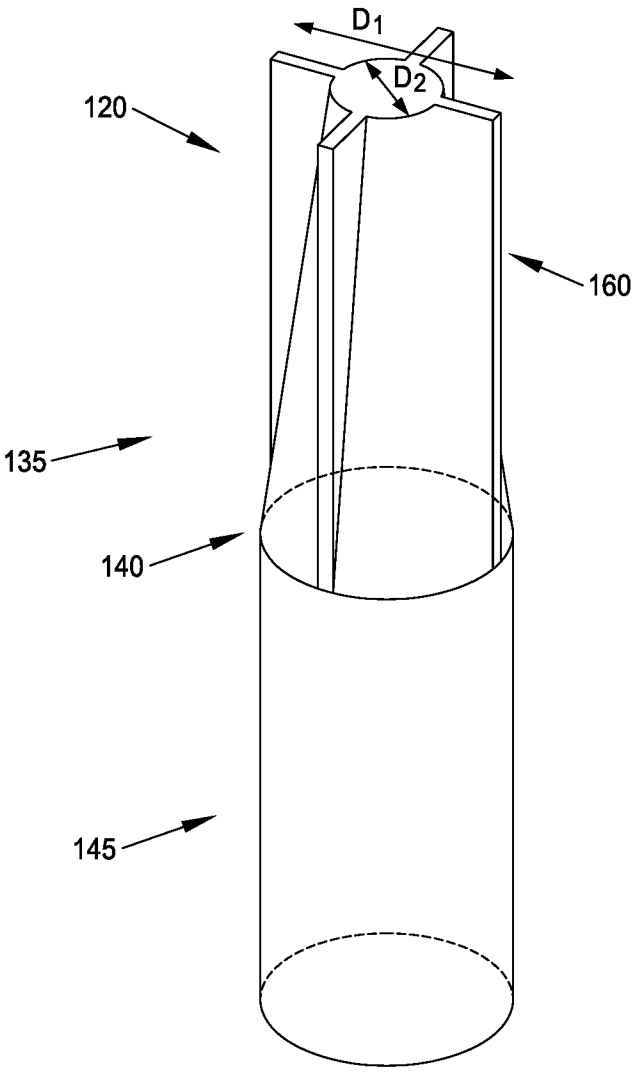

Looking now at FIGS. 3-6, there are shown further details of novel support elements 120. More particularly, each support element 120 generally comprises a first end 125 and a second end 130. A first portion 135 extends from first end 125 to a zone of demarcation 140 (i.e., a point located between first end 125 and second end 130). A second portion 145 extends from second end 130 to zone of demarcation 140. It will be appreciated that, in a preferred form of the invention, zone of demarcation 140 is disposed at a midpoint between first end 125 and second end 130 (e.g., as depicted in FIG. 3). However, it should be appreciated that, if desired, zone of demarcation 140 may be located at substantially any other location between first end 125 and second end 130.

First portion 135 generally comprises a solid frustoconical body 150 defined by a first diameter $D_1$ where first portion 135 abuts zone of demarcation 140, and tapering to a second, smaller diameter $D_2$ where frustoconical body 150 terminates in a generally planar, circular surface 155 at first end 125. A plurality of flats 160 extend radially outward from frustoconical body 150 to a radial distance that is equal to $D_1$ of frustoconical body 150. In a preferred form of the invention, four flats 160 extend radially outward from frustoconical body 150 to radial distances equal to $D_1$ of frustoconical body 150, such that the combined radial distance spanned by any two diametrically-opposed flats 160 is equal to $D_1$ of frustoconical body 150.

Second portion 145 generally comprises a solid cylindrical body 165 having a diameter equal to $D_1$. Second portion 145 is mounted to first portion 135 at zone of demarcation 140, or is formed integral therewith.

Support elements 120 which are disposed adjacent to one another are arrayed in an alternating manner across the entire cushion 105, with the first portion 135 of a first support element 120 abutting the second portion 145 of an adjacent, second support element 120. See FIGS. 3-5. Radially-extending flats 160 of first portion 135 are mounted to (or formed integral with) the exterior surface of cylindrical body 165 of second portion 145 of an adjacent support element 120 (see FIG. 3) to connect first portion 135 of a first support element 120 to a second portion 145 of an adjacent support element 120. If desired, the number of radially-extending flats 160 connecting first portion 135 of support element 120 to second portion 145 of an adjacent support element 120 can be increased to more than 4 flats (e.g. between 5 to 8 flats) or decreased to less than 4 flats (e.g., 2 or 3 flats), depending on the amount of support (e.g., the degree of resiliency) desired for cushion 105.

Alternatively, if desired, the number of radially-extending flats 160 connecting first portion 135 of support element 120 to second portion 145 of an adjacent support element 120 can vary between support members 120. With this form of the invention, a zone comprising a plurality of support elements (e.g., a central zone, a peripheral zone, etc.) may comprise a greater number of radially-extending flats 160 than an adjacent zone comprising a plurality of support elements. As a result of this construction, novel cushion 105 may comprise a plurality of zones having different degrees of resiliency. Furthermore, if desired, adjacent support elements 120 may also be connected together at the adjacent zones of demarcation 140.

As a result of the foregoing construction, when an object (e.g., a person) is disposed on top surface 115 of cushion 105, support elements 120 deform (e.g., compress longitudinally) to support the weight of the object, with each of the first portions 135 flexing to a slightly greater degree than each of the second portions 145, owing to their frustoconical geometry (which provides somewhat reduced column strength relative to the solid cylindrical body 165 of second portion 145). At the same time, flats 160 provide interconnected strength which prevents first portion 135 from compressing too much relative to the weight of the object. Thus, the novel configuration of support elements 120, combined with the novel geometry of first portions 135, permits support elements 120 to compress/flex as needed in order to eliminate peak pressure areas and evenly distribute the force resulting from the weight of the object disposed on top surface 115 of cushion 105 over a substantial area (e.g., the surface area of bottom surface 110).

MODIFICATIONS OF THE PREFERRED EMBODIMENTS

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. Apparatus for cushioning and/or supporting an object, the apparatus comprising:

a top surface;

a bottom surface; and a plurality of support elements extending between the top surface and the bottom surface;

wherein each of the plurality of support elements comprises:

a frustoconical body having a first end and a second end; and a cylindrical body having a first end and second end;

wherein the first end of the frustoconical body comprises a first diameter $D_1$ adjacent the first end of the cylindrical body which tapers to a second, smaller diameter $D_2$ at the second end of the frustoconical body, and further wherein at least one flat extends radially outward from the frustoconical body to a distance that axially aligns an outer surface of the at least one flat with an outer surface of the cylindrical body, wherein the plurality of support elements are arranged in an alternating pattern such that the at least one flat of the frustoconical body is connected to the cylindrical body of an adjacent one of the plurality of support elements.

2. The apparatus according to claim 1 comprising at least two diametrically-opposed flats extending radially outward from the frustoconical body, such that the outer surfaces of the at least two diametrically-opposed flats are disposed from one another at a distance equal to $D_1$.

3. The apparatus according to claim 1 comprising two pairs of diametrically-opposed flats extending radially outward from the frustoconical body, such that the outer surfaces of any two diametrically-opposed flats are disposed at a distance equal to $D_1$.

4. The apparatus according to claim 3 wherein one of the two pairs of diametrically-opposed flats is radially disposed at 90 degrees relative to an other flat.

5. The apparatus according to claim 1 wherein the second portion comprises a solid cylindrical body having a diameter equal to the first diameter $D_1$.

6. The apparatus according to claim 1 wherein the cylindrical body is mounted to the frustoconical body.

7. The apparatus according to claim 1 wherein the frustoconical body is formed integral with the cylindrical body.

8. The apparatus according to claim 1 wherein each of the plurality of support elements are mounted to at least one of the top surface and the bottom surface.

9. The apparatus according to claim 1 wherein the first end of the frustoconical body is connected to the first end of the cylindrical body at a midpoint of a support element.

10. The apparatus according to claim 1 wherein the top surface comprises fabric.

11. The apparatus according to claim 1 wherein the bottom surface comprises a rigid material.

12. The apparatus according to claim 1 wherein the plurality of support elements are resilient.

13. The apparatus according to claim 1 wherein the at least one flat of the frustoconical body is connected to an adjacent cylindrical body along an entire length of the adjacent cylindrical body.

14. A method for cushioning and/or supporting an object, the method comprising:

providing an apparatus comprising:

a top surface;

a bottom surface; and a plurality of support elements extending between the top surface and the bottom surface;

wherein each of the plurality of support elements comprises:

a frustoconical body having a first end and a second end; and a cylindrical body having a first end and second end;

wherein the first end of the frustoconical body comprises a first diameter $D_1$ adjacent the first end of the cylindrical body which tapers to a second, smaller diameter $D_2$ at the second end of the frustoconical body, and further wherein at least one flat extends radially outward from the frustoconical body to a distance that axially aligns an outer surface of the at least one flat with an outer surface of the cylindrical body wherein the plurality of support elements are arranged in an alternating pattern such that the at least one flat of the frustoconical body is connected to the cylindrical body of an adjacent one of the plurality of support elements; and disposing an object on the top surface of the apparatus such that the plurality of support elements deform under the weight of the object, whereby to support the object.

15. The method according to claim 14 wherein the plurality of support elements are resilient.

* * * * *